US008081118B2

(12) United States Patent
McCarthy et al.

(10) Patent No.: US 8,081,118 B2
(45) Date of Patent: Dec. 20, 2011

(54) PHASED ARRAY ANTENNA RADIATOR ASSEMBLY AND METHOD OF FORMING SAME

(75) Inventors: Bradley L. McCarthy, Torrance, CA (US); Randall J. Moss, Thousand Oaks, CA (US); Lynn E. Long, Manhattan Beach, CA (US); Lindsay M. Brisbin, Redondo Beach, CA (US)

(73) Assignee: The Boeing Company, Chicago, IL (US)

( * ) Notice: Subject to any disclaimer, the term of this patent is extended or adjusted under 35 U.S.C. 154(b) by 675 days.

(21) Appl. No.: 12/121,082

(22) Filed: May 15, 2008

(65) Prior Publication Data

US 2009/0284436 A1 Nov. 19, 2009

(51) Int. Cl.
*H01Q 1/38* (2006.01)
*H01P 11/00* (2006.01)

(52) U.S. Cl. ..... 343/700 MS; 343/893; 343/873; 29/600

(58) Field of Classification Search ..... 343/700 MS, 343/893, 873; 29/600
See application file for complete search history.

(56) References Cited

U.S. PATENT DOCUMENTS

| | | | | |
|---|---|---|---|---|
| 4,479,131 | A | 10/1984 | Rogers et al. | |
| 4,937,585 | A * | 6/1990 | Shoemaker | 343/700 MS |
| 5,325,103 | A * | 6/1994 | Schuss | 343/700 MS |
| 5,373,306 | A | 12/1994 | Amore et al. | |
| 5,767,808 | A * | 6/1998 | Robbins et al. | 343/700 MS |
| 5,880,694 | A * | 3/1999 | Wang et al. | 343/700 MS |
| 6,482,521 | B1 | 11/2002 | Lee et al. | |
| 6,686,885 | B1 | 2/2004 | Barkdoll et al. | |
| 2007/0181875 | A1 * | 8/2007 | Yamazaki et al. | 257/40 |

* cited by examiner

*Primary Examiner* — Dieu H Duong
(74) *Attorney, Agent, or Firm* — Harness, Dickey & Pierce, P.L.C.

(57) ABSTRACT

A phased array antenna radiator assembly that in one embodiment has a thermally conductive foam substrate, a plurality of metal radiating elements bonded to the foam substrate, and a radome supported adjacent the metal radiating elements. In another embodiment a phased array antenna radiator assembly is disclosed that has a thermally conductive substrate, a plurality of metal radiating elements bonded to the thermally conductive substrate, a radome supported adjacent the metal radiating elements, and an electrostatically dissipative adhesive in contact with the radiating elements for bonding the radome to the thermally conductive substrate.

14 Claims, 5 Drawing Sheets

PHASED ARRAY ANTENNA RADIATOR ASSEMBLY AND METHOD OF FORMING SAME

FIELD

The present disclosure relates to phased array antennas, and more particularly to a phased array antenna radiator assembly having improved thermal conductivity and electrostatic discharge protection.

BACKGROUND

The statements in this section merely provide background information related to the present disclosure and may not constitute prior art.

When manufacturing a scalable phased array antenna for space-based operation, the challenge is fabricating a phased array radiator assembly that is simple to manufacture in large quantities, has low mass, and a low profile, and will meet challenging performance requirements. These requirements include good thermal conductivity through the internal radiator structure, good end-of-life thermal radiative properties (solar absorptance and emittance) at the outer exposed surface of the antenna, and the electrostatic discharge (ESD) grounding requirement for the floating metal elements without compromising the required low RF loss performance. In addition, the materials selected must be capable of resisting degradation due to the natural radiation environment or through atomic oxygen (AO) erosion.

Existing solutions that have good RF properties, for example certain commercially available foams, typically have generally unacceptable thermal conductivity for an application where passive cooling of a phased array antenna is required. As such, pre-existing foams are generally considered to be unacceptable for dissipating heat from the printed wiring board (PWB) modules of a scalable phased array antenna through the radiator assembly of the antenna. Existing solutions using heat pipes and radiators at the edges of the arrays to dissipate heat are heavy and increase the complexity in integration and test for a phased array antenna. Such solutions often significantly increase the cost of manufacture as well.

Many current radiator designs have a gapped radome, which is also termed a "sunshield blanket", disposed over the antenna aperture above the foam tile assembly. This arrangement is also generally viewed as unacceptable for dissipating heat. To ESD ground floating metal patches, an existing solution is to have a ground pin at the center of each patch. However, this is very difficult and complex to accomplish with foam since manufacturing plated via holes through the foam is not a standard PWB process with proven reliability, and may not be useful for stacked patch configurations.

In general, a primary disadvantage of existing radiator designs for a phased array antenna is that they are highly complex to manufacture. The current solutions are not practical for manufacturing in quantities sufficiently large to make a phased array antenna. Also, the thermal conductivity of presently available foam tile is too low for dissipating heat, while other heat dissipating solutions (e.g., heat pipes) and other grounding methods (e.g., metal pins) add weight. Moreover, flouropolymer based adhesives can be degraded by space radiation effects.

SUMMARY

In one aspect a phased array antenna radiator assembly is disclosed. The radiator assembly may comprise a thermally conductive foam substrate, a plurality of metal radiating elements bonded to the foam substrate, and a radome supported adjacent said metal radiating elements.

In another aspect a phased array antenna radiator assembly is disclosed that may comprise a thermally conductive substrate, a plurality of metal radiating elements bonded to the thermally conductive substrate, a radome supported adjacent said metal radiating elements, and an electrostatically dissipative adhesive in contact with said radiating elements for bonding said radome to said thermally conductive substrate.

In another aspect a method is disclosed for forming a phased array antenna radiator assembly. The method may comprise forming a plurality of radiating elements on a thermally conductive foam substrate, laying a radome over the radiating elements, and bonding the radome to the foam substrate.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
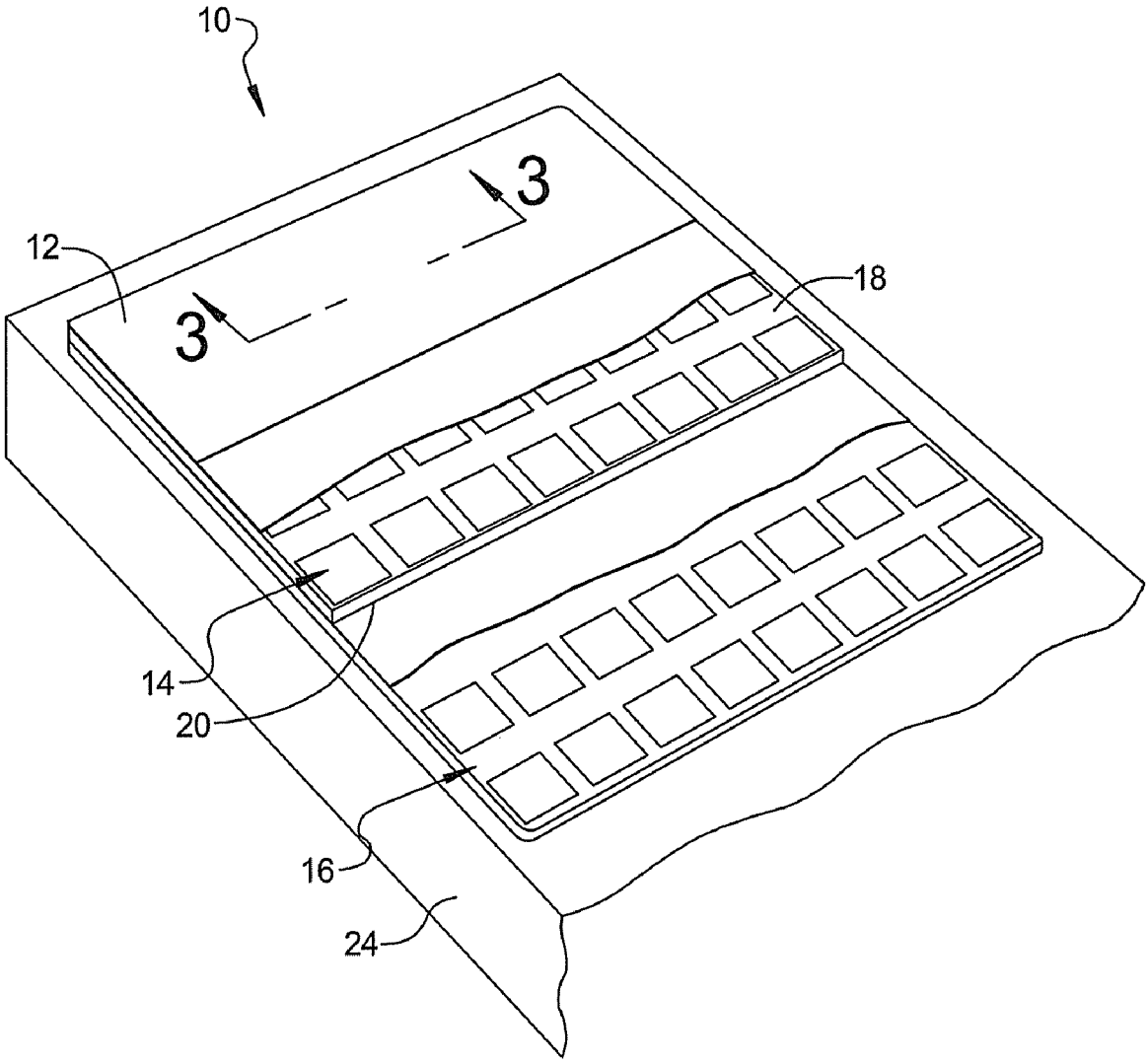
FIG. 1 is a perspective cutaway view of a phased array antenna radiator assembly in accordance with one embodiment of the present disclosure.

Referring to FIG. 1, there is shown a phased array antenna radiator assembly 10 (hereinafter "radiator assembly" 10) in accordance with one embodiment of the present disclosure. The radiator assembly 10 in this embodiment has a multilayer assembly with a plurality of radiating layers 14 and 16 made up of a plurality of independent metal electromagnetic radiating/reception (hereinafter simply "radiating") elements. A radome 12, also known as a "sunshield", is disposed over the first radiating layer 14 and is bonded to a first surface 18 of the first radiating layer 14. A second surface 20 of the first radiating layer 14 is bonded to a first surface 22 of the second radiating layer 16. The entire radiator assembly 10 forms a microstrip radiator that may be supported on and electrically coupled to a printed wiring board assembly 24 having electronic circuitry (not shown) for providing the RF feed to the antenna radiating assembly 10.

Figure 2:
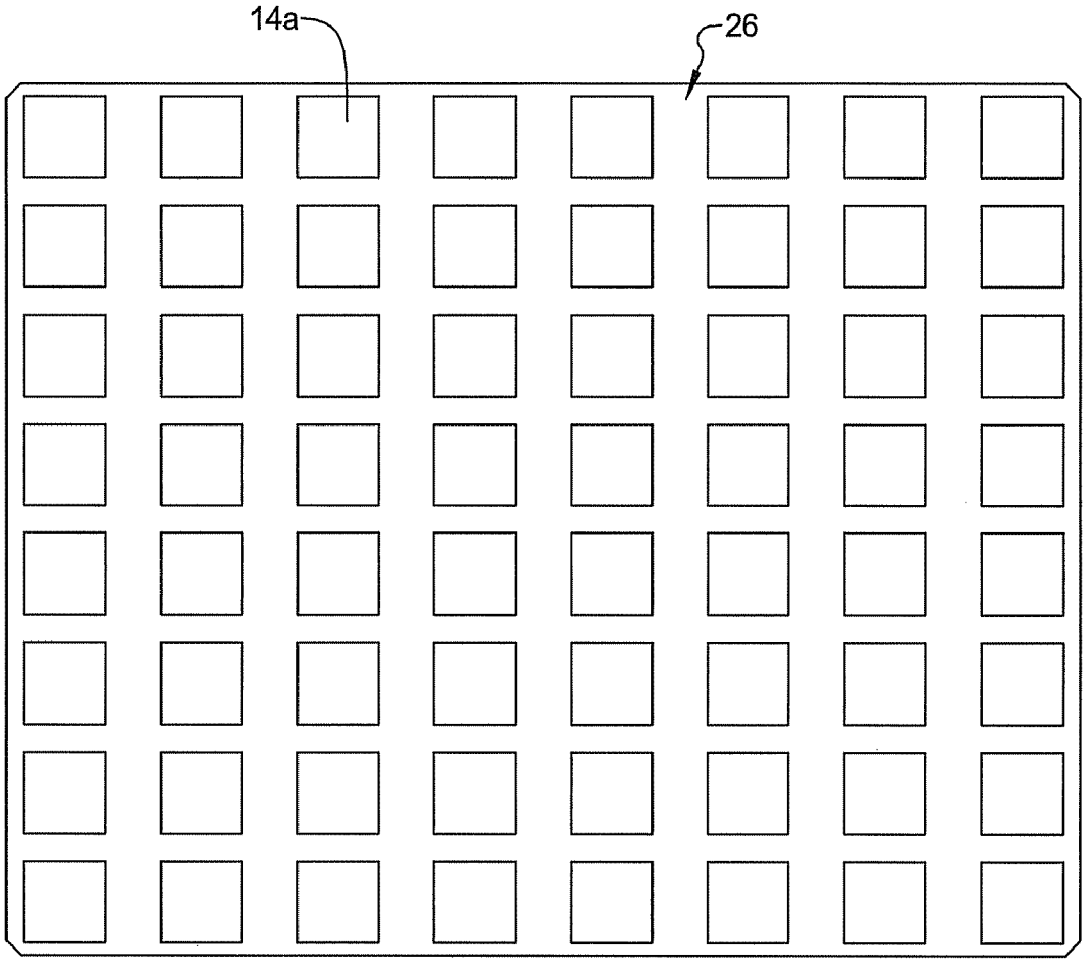
FIG. 2 is a plan view of the radiators of the antenna radiator assembly of FIG. 1 but without the radome shown.

With reference to FIG. 2, and as will be described further in the following paragraphs, the first radiating layer 14 may be formed by a photolithographic process where a layer of metal such as copper or another suitable metal conductor is deposited to form a film layer, typically having a thickness between about 0.001 inch-0.004 inch (0.0254 mm-0.1016 mm). The metal layer may then be etched through the use of a mask to remove metal so that a plurality of independent radiating elements are formed. In FIG. 1 the metal radiating elements are labeled 14*a* in the first radiating layer 14, and 16*a* in the second radiating layer 16. The metal radiating elements 14*a* and 16*a* may be thought of as "floating" metal "patches". While the radiating elements 14*a* and 16*a* are shown as having a generally square shape in FIG. 2, it will be appreciated that the radiating elements 14*a* and 16*a* could have been formed to have any other suitable shape, for example that of a circle, a hexagon, a pentagon, a rectangle, etc. Also, while only two layers of radiating elements have been shown, it will be appreciated that the radiator assembly 10 could comprise either fewer than two layers or more than two layers to meet the needs of a specific application. In one embodiment the radiating elements 14*a* and 16*a* may each be about 0.520 inch (13.21 mm) square.

The radome 12 may be constructed of any suitable material that is essentially RF transparent. For example, the radome 12 may be constructed of KAPTON®. Alternatively, the radome may be constructed as a multilayer laminate.

Figure 3:
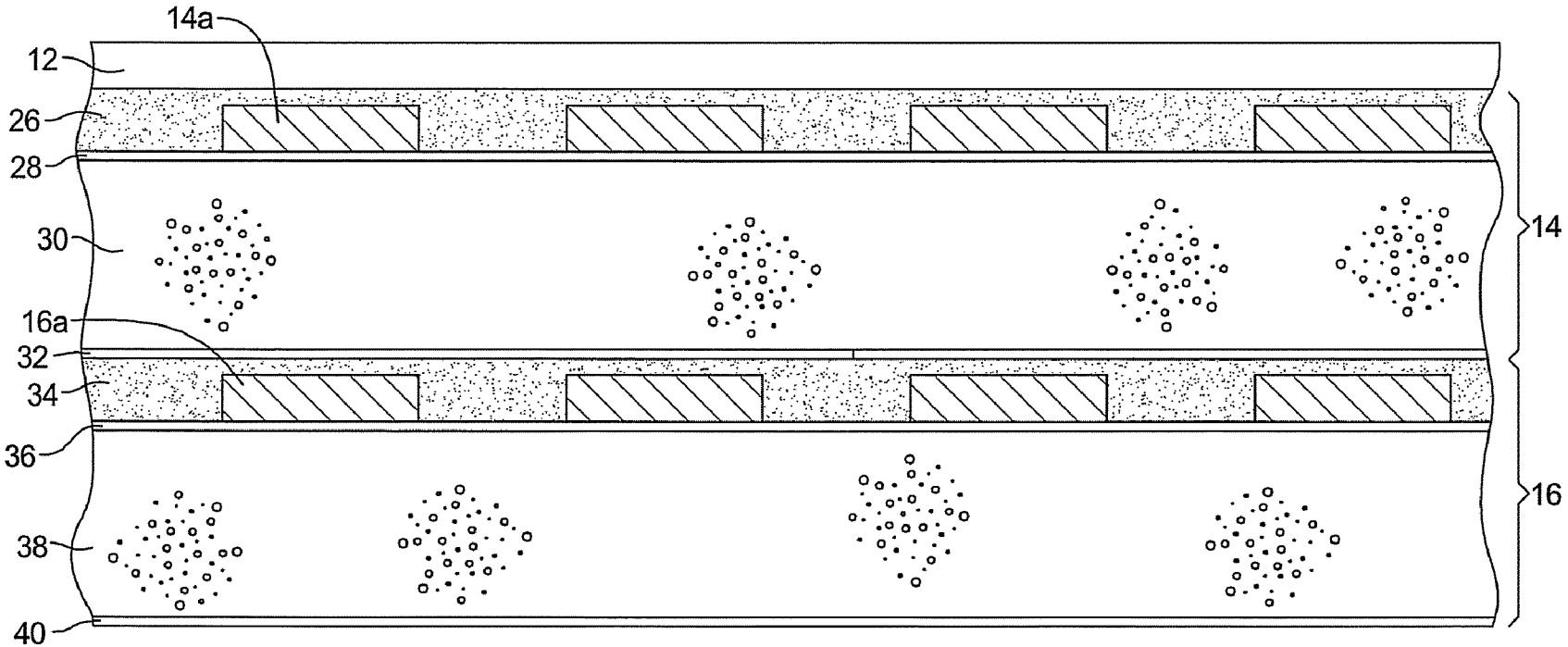
FIG. 3 is a side cross sectional view of the antenna radiator assembly of FIG. 1 taken in accordance with section line 3-3 in FIG. 1.

Referring to FIG. 3, a more detailed view of a portion of the radiator assembly 10 is shown. The radiator assembly 10 includes the radome 12, a layer of electrostatically dissipative adhesive 26, a first epoxy film adhesive layer 28, a first low RF loss, syntactic foam substrate 30, a second epoxy film adhesive layer 32, a second layer of electrostatically dissipative adhesive 34, a third epoxy film adhesive layer 36, a second low RF loss, syntactic foam substrate 38 and a fourth epoxy film adhesive layer 40. The layers 26, 28, 30 and 32 can be viewed as forming the first layer of radiating elements 14, while the layers 34, 36, 38 and 40 can be viewed as forming the second layer of radiating elements 16. The epoxy film adhesive layers 28,32 and 36,40 serve to bond the metal foil used to form the radiating layers 14 and 16 to their respective foam substrates 30 and 38, respectively. The epoxy film adhesive layers 28,32 and 36/40 also seal the syntactic foam substrates 30 and 38 from the standard printed wiring board (PWB) processing solutions used when the various layers are being laminated to form the radiator assembly 10. The epoxy film adhesive layers 28,32 and 36,40 may be comprised of epoxy based or Cyanate ester based material. Both of these materials can be easily made into film adhesives and both have good electrical properties.

Although the thickness of the various layers shown in FIG. 3 may vary to meet the needs of a specific application, in one example the syntactic foam substrates 30 and 38 are each between about 0.045 inch-0.055 inch (1.143 mm-1.397 mm) thick. The electrostatically dissipative adhesives 26 and 34 may form layers that vary in thickness, but in one embodiment are between about 0.001 inch-0.005 inch (0.0254 mm-0.127 mm) thick. The epoxy adhesive films 28, 32, 36 and 40 may also vary considerably in thickness to meet the needs of a specific application, but in one embodiment are between about 0.001 inch-0.003 inch (0.0254 mm-0.0762 mm) thick. The radome 12 typically may be between about 0.003 inch-0.005 inch (0.0762 mm-0.127 mm) thick.

A significant feature of the radiator assembly 10 is the use of the low RF loss, syntactic foam substrates 30 and 38. Foam substrates 30 and 38 each form an excellent thermal path through the thickness of their respective radiating layer 14 or 16. Thus, no "active" cooling of the radiator assembly 10 is required. By "active" cooling it is meant a cooling system employing water or some other cooling medium that is flowed through a suitable network or grid of tubes to absorb heat generated by the radiator assembly 10 and transport the heat to a thermal radiator to be dissipated into space. The use of active cooling significantly increases the cost and complexity, size and weight of a phased array antenna system. Thus, the passive cooling that is achieved through the use of the syntactic foam substrates 30 and 38 enables the radiator assembly 10 to be made to smaller dimensions and with less weight, less cost and less manufacturing complexity than previously manufactured phased array radiating assemblies.

Figure 4:
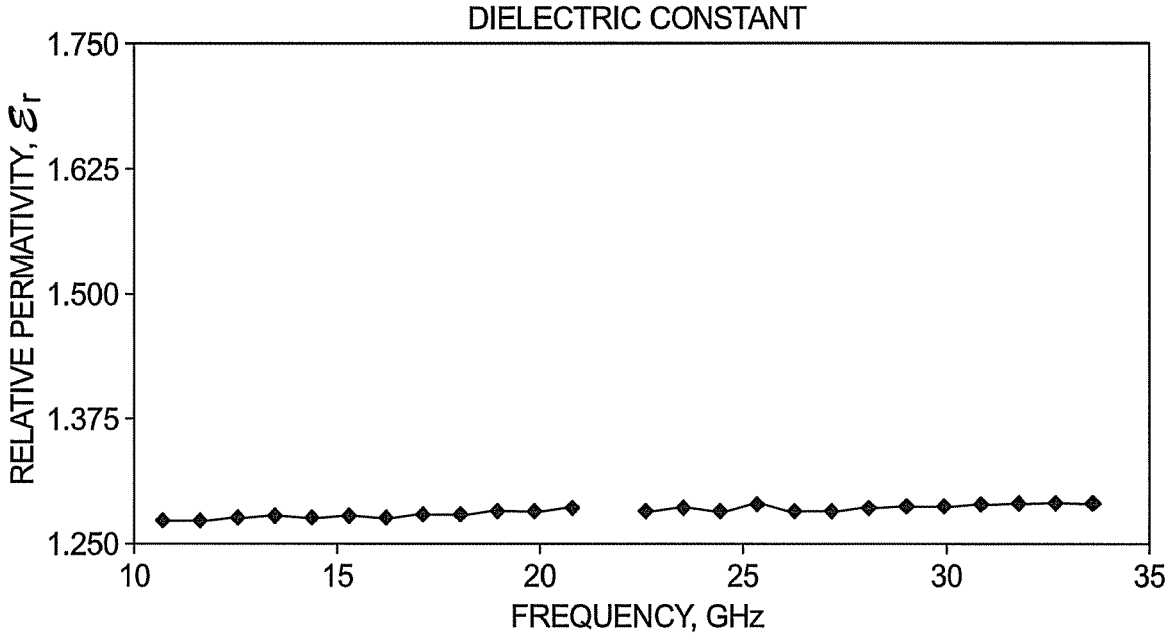
FIG. 4 is a graph illustrating the dielectric property of the foam substrate used in the antenna radiator assembly of FIG. 1.
Figure 5:
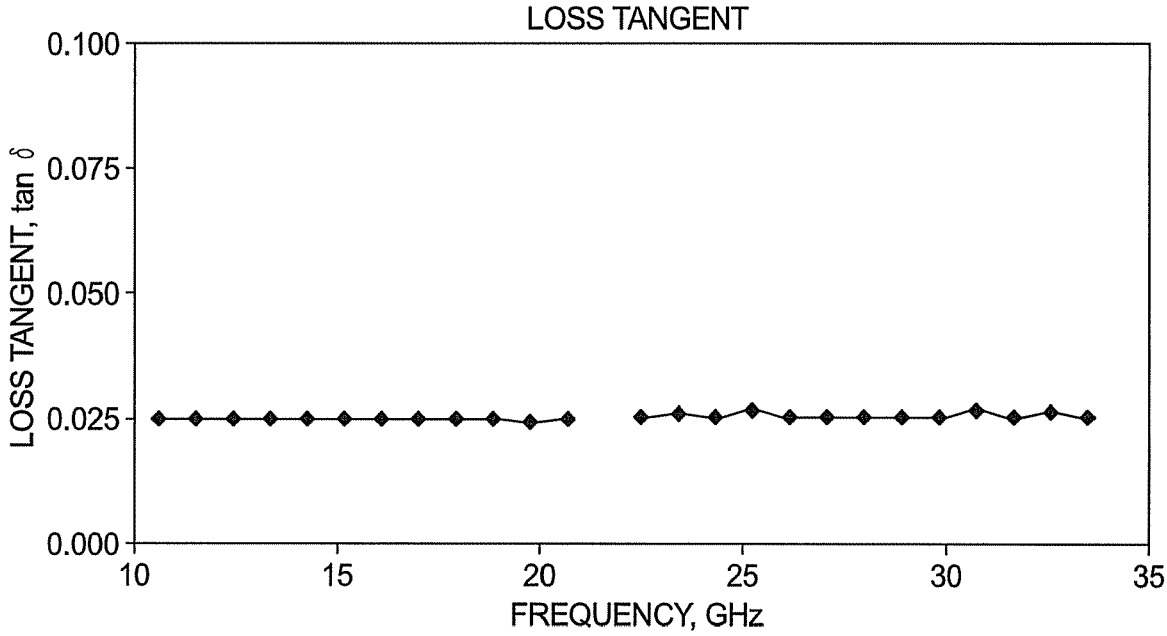
FIG. 5 is a graph of the loss tangent of the foam substrate used in the antenna radiator assembly of FIG. 1.

The syntactic foam substrates 30 and 38 each may be formed as fully-crosslinked, low density, composite foam substrates that exhibit low loss characteristics in the microwave frequency range. The foam substrates 30 and 38 may each have a dielectric constant as shown in FIG. 4 and a loss tangent as shown in FIG. 5. In FIG. 5, it will be noted that the loss tangent, which is the radio frequency (RF) loss of an electromagnetic wave passing through the foam substrate 30 or 38, is about 0.005. Advantageously, this loss is also relatively constant over a wide bandwidth and has been measured from about 12 Ghz to about 33 GHz. The thermal resistance of each of the foam substrates 30 and 38 is preferably less than about 50.2 degrees C./W. Each foam substrate 30 and 38 also preferably has a thermal conductivity of at least about 0.0015 watts per inch per degrees C (W/inC), or at least about 0.0597 watts per meter per degree Kelvin (W/mK). One particular syntactic foam that is commercially available and suitable for use is DI-STRATE™ foam tile available from Aptek Laboratories, Inc. of Valencia, Calif.

An additional significant benefit of the construction of the radiator assembly 10 is the use of the electrostatically dissipative adhesive 26 to bond the radome 12 to the syntactic foam substrate 30, and the electrostatically dissipative adhesive 34 to bond the syntactic foam substrate 30 to the syntactic foam substrate 38. In this example the adhesives 26 and 34 are the same, however, slightly different adhesive formulations could be used provided they each possess an electrostatically dissipative quality. Adhesive 26 extends over and around each of the radiating elements 14*a* and physically contacts each of the radiating elements 14*a*. The adhesive 26 allows any electrostatic charge buildup on the radiating elements 14*a* to be conducted away from the radiating elements 14*a*. The same construction applies for electrostatically dissipative adhesive 34, which surrounds and extends over the radiating elements 16*a*, and is in contact with each radiating element. It will be appreciated that the electrostatically dissipative adhesives 26 and 34 will each be coupled to ground when the radiator assembly 10 is supported on the printed wiring board 24 shown in FIG. 1. The electrostatically dissipative adhesives 26 and 34 may be formed from an epoxy adhesive, a polyurethane based adhesive or a Cyanate ester adhesive, each doped with a small percentage, for example five percent, of conductive polyaniline salt. The precise amount of doping will be dictated by the needs of a particular application Another important feature of the electrostatically dissipative layer 26 is that it helps to form a thermally conductive path to the syntactic foam substrate 30 and eliminates the gap that would typically exist between the radome 12 and the top level of radiating elements 14*a*. By eliminating the gap between the inner surface of the radome 12 and the radiating elements 14*a*, an excellent thermal path is formed from the radome 12 through the first radiating layer 14. The electrostatically dissipative adhesive 34 operates in similar fashion to help promote thermal conductivity of heat from the first syntactic substrate 30 to the second syntactic substrate 38, while also providing a conductive path to bleed off any electrostatic charge that develops on the radiating elements 16*a*.

Figure 6:
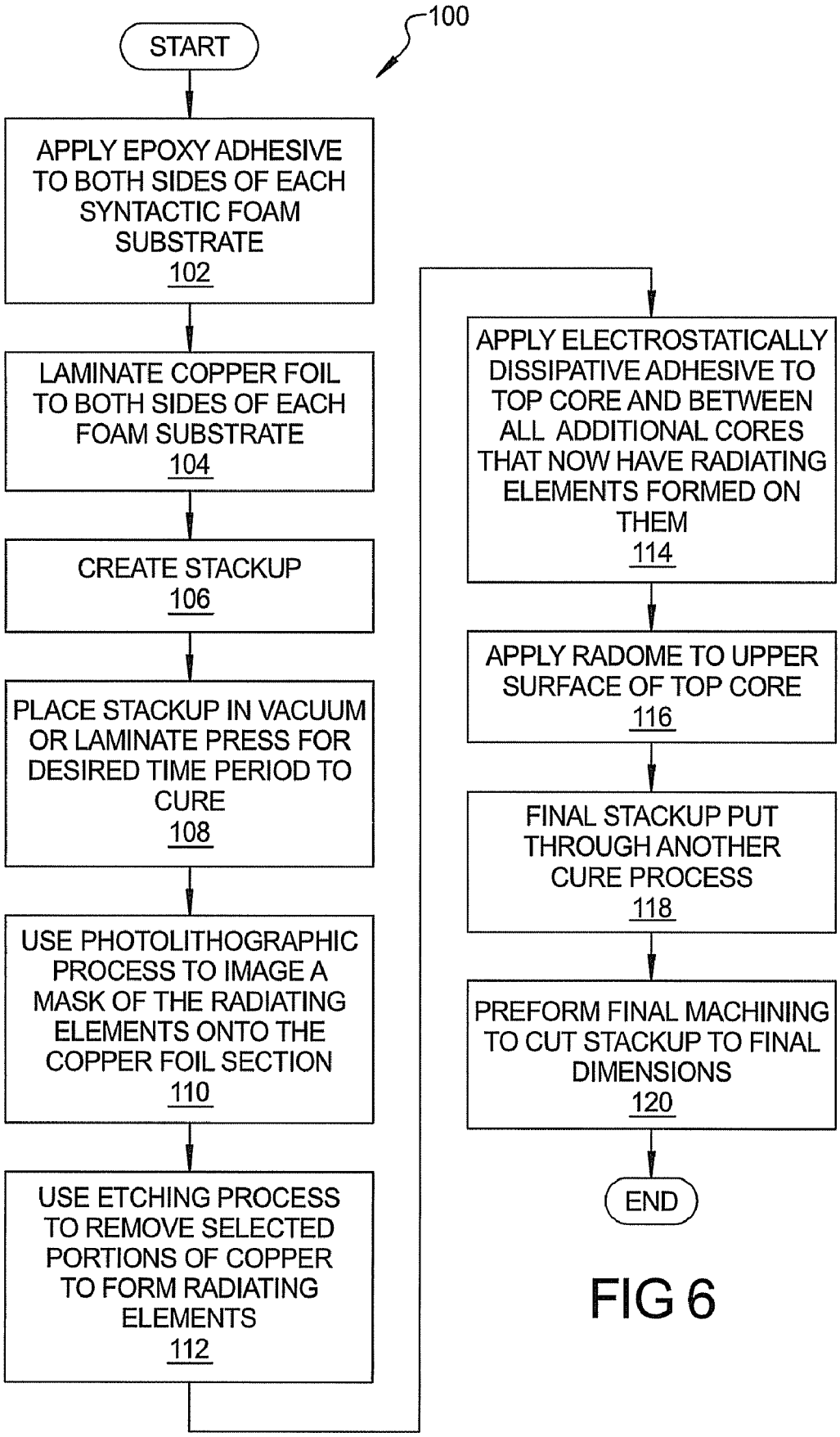
FIG. 6 is a flowchart of operations performed in manufacturing the antenna radiator assembly of FIG. 1.

Referring now to FIG. 6, a flowchart 100 is shown illustrating operations in forming the radiator assembly 10. Initially the epoxy adhesive films 28,32 and 36,40 are applied to both surfaces of both syntactic foam substrates 30 and 38 respectively, as indicated at operation 102. At operation 104 copper foil is laminated, or copper electrodeposited to, the foam substrates 30 and 38 to cover both sides of the foam substrates. At operation 106 a stackup is then created which may include, from top to bottom, copper foil, epoxy film adhesive, foam (e.g., foam substrate 30), epoxy film adhesive, and copper foil. This is done for each of the syntactic foam substrates 30 and 38.

At operation 108 each stackup is placed in a vacuum or laminate press at the cure temperature of the epoxy film adhesive for a predetermined cure time sufficient to cure the stackup. After the epoxy cures, a material "core" is formed that can undergo further printed wiring board processing (e.g., photolithography, etching, plating, etc.).

At operation 110 a photolithographic process is used to image a mask of the radiating elements onto the copper foil. At operation 112 an etching process is then used to selectively remove the copper which will not be needed to form the radiating elements 14*a* and 16*a* on the radiating layers 14 and 16, respectively.

At operation 114, after the foam core undergoes photolithography and etching processes, the electrostatically dissipative adhesive is applied to the top core and between all additional cores that now have radiating elements (i.e., elements 14*a* or 16*a*) formed on them. At operation 116 the radome is applied to the electrostatically dissipative adhesive on an upper surface of the top core. At operation 118 the final stackup (i.e., the stackup comprising both foam cores) then undergoes another cure process which hardens the electrostatically dissipative adhesive and makes all the layers permanently adhere to one another to form an assembly. At operation 120 final machining is performed to cut the oversized material stackup to the antenna radiator assembly's 10 final dimensions.

The radiator assembly 10 of the present disclosure does not require the expensive and complex active heating required of other phased array antennas, and can further be manufactured cost effectively using traditional manufacturing processes. The passive cooling feature of the radiator assembly 10 enables the radiator assembly to be made even more compact than many previously developed phased array radiator assemblies, and with less complexity, less weight and less cost. The passive cooling feature of the radiator assembly 10 is expected to enable the radiator assembly 10 to be implemented in applications where cost, complexity or weight might otherwise limit an actively cooled phased array antenna from being employed such as for space based radar and communications systems.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A phased array antenna radiator assembly comprising:

a thermally conductive foam substrate;

a plurality of metal radiating elements bonded to the foam substrate;

a radome supported adjacent said metal radiating elements;

a static dissipative adhesive layer disposed on said foam substrate and in contact with said radiating elements for electrostatically grounding said radiating elements, the static dissipative adhesive layer encasing each of the radiating elements and bonding the radome over the metal radiating elements;

a planar film adhesive layer for bonding the metal radiating elements to the foam substrate while sealing a surface of the foam substrate; and an additional plurality of radiating elements having a first surface facing said foam substrate and being bonded to said foam substrate, and a second surface bonded to an additional foam substrate, to form a multilayer assembly.

2. The antenna radiator assembly of claim 1, wherein said static dissipative adhesive layer also bonds said radome to said foam substrate.

3. The antenna radiator assembly of claim 1, wherein said planar film adhesive layer comprises an epoxy film adhesive.

4. The antenna radiator assembly of claim 1, wherein said foam substrate comprises a thermal resistance of no more than about 50.2 degrees C./W.

5. The antenna radiator assembly of claim 1, wherein said foam substrate comprises a loss tangent of no more than about 0.005 over a frequency range between about 11 GHz to about 33 GHz.

6. The antenna radiator assembly of claim 1, wherein said static dissipative adhesive layer comprises an adhesive material doped with polyaniline.

7. The antenna radiator assembly of claim 6, wherein the static dissipative adhesive layer comprises one of:

polyurethane;

epoxy; and

Cyanate ester.

8. A phased array antenna radiator assembly comprising:

a thermally conductive foam substrate;

a plurality of metal radiating elements bonded to the thermally conductive substrate;

a radome supported adjacent said metal radiating elements; and an electrostatically dissipative adhesive layer in contact with said metal radiating elements for bonding said radome to said thermally conductive foam substrate, the electrostatically dissipative adhesive layer encasing the metal radiating elements therein;

the electrostatically dissipative adhesive layer disposed on said thermally conductive foam substrate and in contact with said metal radiating elements for electrostatically grounding said metal radiating elements, the electrostatically dissipative adhesive layer bonding the radome over the metal radiating elements so that the radome overlays said metal radiating elements;

a planar film adhesive layer for bonding the metal radiating elements to the foam substrate while sealing a surface of the foam substrate; and an additional plurality of radiating elements having a first surface facing said foam substrate and being bonded to said foam substrate, and a second surface bonded to an additional foam substrate, to form a multilayer assembly.

9. The antenna radiator assembly of claim 8, wherein said film adhesive comprises an epoxy film adhesive.

10. The antenna radiator assembly of claim 8, wherein said substrate comprises a syntactic foam substrate.

11. The antenna radiator assembly of claim 10, wherein said syntactic foam substrate comprises a thermal resistance of no more than about 50.2 degrees C./W.

12. The antenna radiator assembly of claim 8, wherein said substrate comprises a syntactic foam substrate having a loss tangent of no more than about 0.005 over a frequency range from about 12 GHz to about 33 GHz.

13. A method for forming a phased array antenna radiator assembly, comprising:

forming a plurality of radiating elements on a thermally conductive foam substrate;

laying a radome over the radiating elements;

bonding the radome to the foam substrate;

placing an electrostatically dissipative adhesive on said foam substrate over said radiating elements, and using the electrostatically dissipative adhesive to bond the radome to the foam substrate with the radiating elements sandwiched between the foam substrate and the radome;

placing a planar film adhesive layer for bonding the metal radiating elements to the foam substrate while sealing a surface of the foam substrate; and bonding an additional plurality of radiating elements having a first surface facing said foam substrate, to said foam substrate, and bonding a second surface of said additional plurality of radiating elements to an additional foam substrate, to form a multilayer assembly.

14. The method of claim 13, wherein forming a plurality of radiating elements comprises electrodepositing copper on the thermally conductive foam substrate and etching away a portion of the copper to form the radiating elements.

* * * * *